US006705406B2

(12) United States Patent
Das et al.

(10) Patent No.: US 6,705,406 B2
(45) Date of Patent: Mar. 16, 2004

(54) REPLACEABLE ELECTRICAL DEVICE FOR A DOWNHOLE TOOL AND METHOD THEREOF

(75) Inventors: Pralay K. Das, Sugar Land, TX (US); Joe Marzouk, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/106,540

(22) Filed: Mar. 26, 2002

(65) Prior Publication Data

US 2003/0183384 A1 Oct. 2, 2003

(51) Int. Cl.[7] ..... E21B 23/00
(52) U.S. Cl. ..... 166/381; 166/65.1
(58) Field of Search ..... 166/65.1, 66, 250.01, 166/250.11, 377, 380, 381; 175/320

(56) References Cited

U.S. PATENT DOCUMENTS

| | | | | |
|---|---|---|---|---|
| 3,746,106 A | | 7/1973 | McCullough et al. | |
| 4,787,463 A | | 11/1988 | Geller et al. | |
| 5,061,849 A | | 10/1991 | Meisner et al. | |
| 5,253,721 A | | 10/1993 | Lee | |
| RE35,790 E | * | 5/1998 | Pustanyk et al. | 175/40 |
| 5,794,719 A | | 8/1998 | Holloway | |
| 6,280,874 B1 | | 8/2001 | Hensley et al. | 429/98 |
| 6,349,778 B1 | | 2/2002 | Blair et al. | |
| 6,523,609 B1 | * | 2/2003 | Miszewski | 166/250.11 |
| 2002/0005282 A1 | | 1/2002 | Holbert et al. | |
| 2003/0072218 A1 | * | 4/2003 | Smith | 367/83 |

FOREIGN PATENT DOCUMENTS

| | | |
|---|---|---|
| GB | 2357306 | 6/2001 |

* cited by examiner

*Primary Examiner*—David Bagnell
*Assistant Examiner*—Brian Halford
(74) *Attorney, Agent, or Firm*—Madan, Mossman & Sriram, P.C.

(57) ABSTRACT

A downhole tool for use in a wellbore, comprises a tubular member, such as a drill collar housing, in a drill string. The tubular member has at least one cavity formed on an external surface. At least one housing is adapted to be insertable and extractable in the cavity without further tool disassembly. The housing has at least one electrical device such as a battery stack disposed within. In another aspect, sensors are disposed in the housing for measuring downhole parameters of interest including, but not limited to, annulus pressure and annulus temperature. A method of replacing an electrical device in a downhole tool, comprises removing a first housing containing the electrical device from a cavity on an external surface of the downhole tool, and installing a second housing containing a second electrical device in the cavity without disassembling the tool further.

12 Claims, 4 Drawing Sheets

REPLACEABLE ELECTRICAL DEVICE FOR A DOWNHOLE TOOL AND METHOD THEREOF

BACKGROUND OF THE INVENTION

1. Field of the Invention

The invention relates generally to a tool for use in an oilfield wellbore, and more specifically to an easily replaceable electrical device for use in such a tool.

2. Description of the Related Art

Tools requiring electrical power are often used for conducting various operations in a wellbore. This creates a need for portable electrical power, preferably power that can be mounted directly onto a downhole tool. One way of providing electrical power downhole is through the use of a battery pack. Typically, the battery pack is constructed of multiple cells mounted in rigid plastic, epoxy, fiberglass, or aluminum shells and is housed in a sonde or in an annular housing mounted in the bore of a downhole tool. One or more cells are typically contained within the battery pack. The cells can be electrically connected in various series or parallel configurations to provide the necessary voltage and current capacities required for the various loads. The cells generally are immobilized inside the battery pack by an epoxy. In order to change the battery pack in the downhole tool, the tool has to be disassembled. Disassembly of the tool makes replacing a battery pack time consuming and, in certain cases, is impossible at the job site. For quicker job turnaround, it is desirable that the battery be replaceable without requiring tool disassembly and without the use of specialized equipment typically not available at the job site.

The methods and apparatus of the present invention overcome the foregoing disadvantages of the prior art by providing an externally replaceable battery pack that does not require major tool disassembly.

SUMMARY OF THE INVENTION

In general, in one aspect of the present invention, a downhole tool for use in a wellbore, comprises a tubular member, such as a drill collar housing, in a drill string. The tubular member has at least one cavity formed on an external surface. A housing is adapted to insert in and extract from the cavity. The housing has at least one electrical device, such as a battery stack, disposed within the housing.

In another aspect of the present invention, sensors are disposed in the housing for measuring downhole parameters of interest including, but not limited to, annulus pressure and annulus temperature.

In another embodiment, a replaceable battery pack for a downhole tool in a wellbore, comprises a housing adapted to be insertable in and extractable from a cavity on an external surface of the downhole tool, and has at least one electrical power cell disposed in the housing.

In one aspect, a method of replacing an electrical device in a downhole tool, comprises removing a first housing containing the electrical device from a cavity on an external surface of the downhole tool, and installing a second housing containing a second electrical device in the cavity without disassembling the tool further.

In yet another embodiment, a method of replacing a battery pack in a downhole tool, comprises removing a first housing containing a plurality of electrical power cells from a cavity on an external surface of the downhole tool, and installing a second housing containing a second plurality of electrical power cells in the cavity without disassembling the tool further.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, wherein.

DESCRIPTION OF PREFERRED EMBODIMENTS

Figure 1:
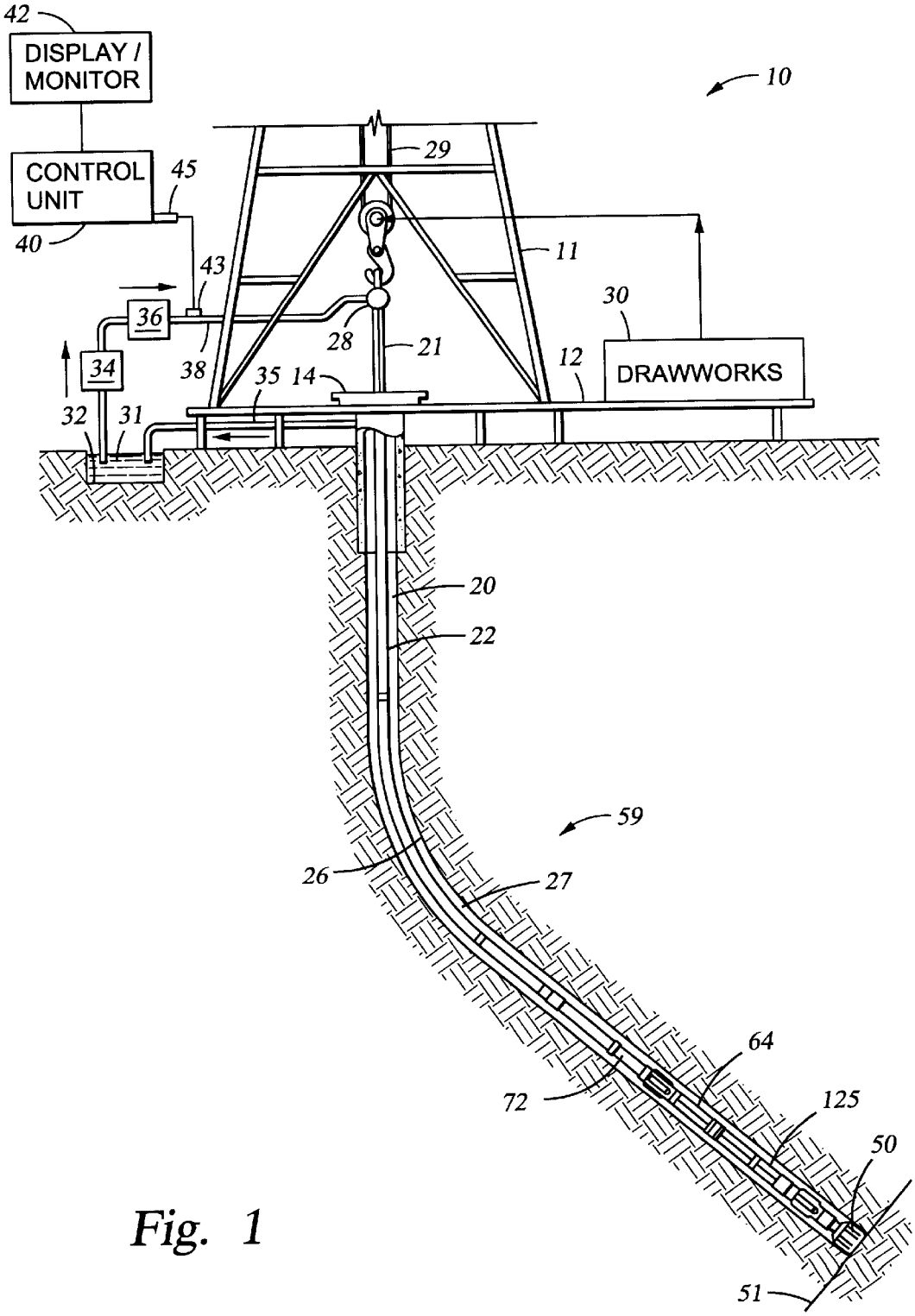
FIG. 1 is a schematic diagram of a drilling system according to one embodiment of the present invention.

FIG. 1 shows a schematic diagram of a drilling system 10 having a downhole assembly containing a downhole sensor system and the surface devices according to one embodiment of present invention. As shown, the system 10 includes a conventional derrick 11 erected on a derrick floor 12 which supports a rotary table 14 that is rotated by a prime mover (not shown) at a desired rotational speed. A drill string 20 that includes a drill pipe section 22 extends downward from the rotary table 14 into a wellbore 26. A drill bit 50 attached to the drill string downhole end disintegrates the geological formations when it is rotated. The drill string 20 is coupled to a drawworks 30 via a kelly joint 21, swivel 28 and line 29 through a system of pulleys (not shown). During the drilling operations, the drawworks 30 is operated to control the weight on bit and the rate of penetration of the drill string 20 into the wellbore 26. The operation of the drawworks is well known in the art and is thus not described in detail herein.

During drilling operations, a suitable drilling fluid (commonly referred to in the art as "mud") 31 from a mud pit 32 is circulated under pressure through the drill string 20 by a mud pump 34. The drilling fluid 31 passes from the mud pump 34 into the drill string 20 via a desurger 36, fluid line 38 and the kelly joint 21. The drilling fluid is discharged at the wellbore bottom 51 through an opening in the drill bit 50. The drilling fluid circulates uphole through the annular space 27 between the drill string 20 and the wellbore 26 and is discharged into the mud pit 32 via a return line 35. Preferably, a variety of sensors (not shown) are appropriately deployed on the surface according to known methods in the art to provide information about various drilling-related parameters, such as fluid flow rate, weight on bit, hook load, etc.

A surface control unit 40 receives signals from the downhole sensors and devices via a sensor 43 placed in the fluid line 38 and processes such signals according to programmed instructions provided to the surface control unit. The surface control unit displays desired drilling parameters and other information on a display/monitor 42 which information is utilized by an operator to control the drilling operations. The surface control unit 40 contains a computer, memory for storing data, data recorder and other peripherals. The surface control unit 40 also includes models and processes data according to programmed instructions and responds to user commands entered through a suitable means, such as a keyboard. The control unit 40 is preferably adapted to activate alarms 44 when certain unsafe or undesirable operating conditions occur.

In the preferred embodiment of the system of present invention, the downhole subassembly 59 (also referred to as the bottomhole assembly or "BHA"), which contains the various sensors and MWD devices to provide information about the formation and downhole drilling parameters, is coupled between the drill bit 50 and the drill pipe 22. The downhole assembly 59 is modular in construction, in that the various devices are interconnected sections.

Referring to FIG. 1, the BHA 59 also preferably contains downhole sensors and devices in addition to the above-described surface sensors to measure downhole parameters of interest. Such devices include, but are not limited to, a device for measuring the formation resistivity near the drill bit, a gamma ray device for measuring the formation gamma ray intensity and devices for determining the inclination and azimuth of the drill string. The formation resistivity measuring device 64 provides signals from which resistivity of the formation near the drill bit 50 is determined.

The above-noted devices transmit data to the downhole telemetry system 72, which in turn transmits the received data uphole to the surface control unit 40. The present invention preferably utilizes a mud pulse telemetry technique to communicate data from downhole sensors and devices during drilling operations. A transducer 43 placed in the mud supply line 38 detects the mud pulses responsive to the data transmitted by the downhole telemetry 72. Transducer 43 generates electrical signals in response to the mud pressure variations and transmits such signals via a conductor 45 to the surface control unit 40. Other telemetry techniques such electromagnetic and acoustic techniques or any other suitable technique may be utilized for the purposes of this invention.

The sensors and telemetry devices can be powered by batteries, downhole alternators, or a combination of such devices. In conventional systems, the power sources are typically contained in the bore of the BHA 59 and require some time-consuming and difficult disassembly to change out batteries. In many instances, such a change-out is impractical at the rig site.

Figure 2:
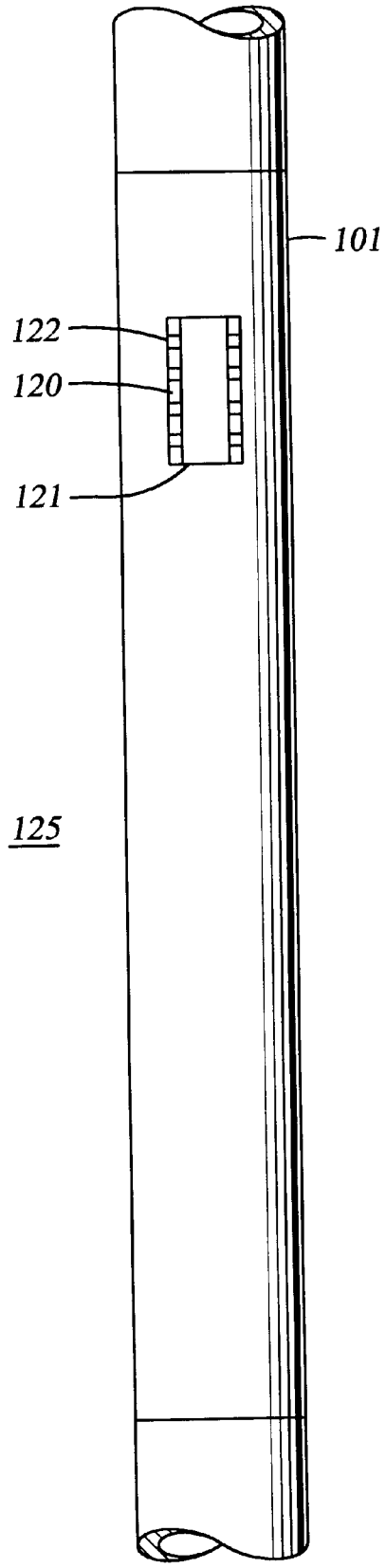
FIG. 2 is a schematic of a downhole tool with a replaceable battery pack according to one embodiment of the present invention.
Figure 3:
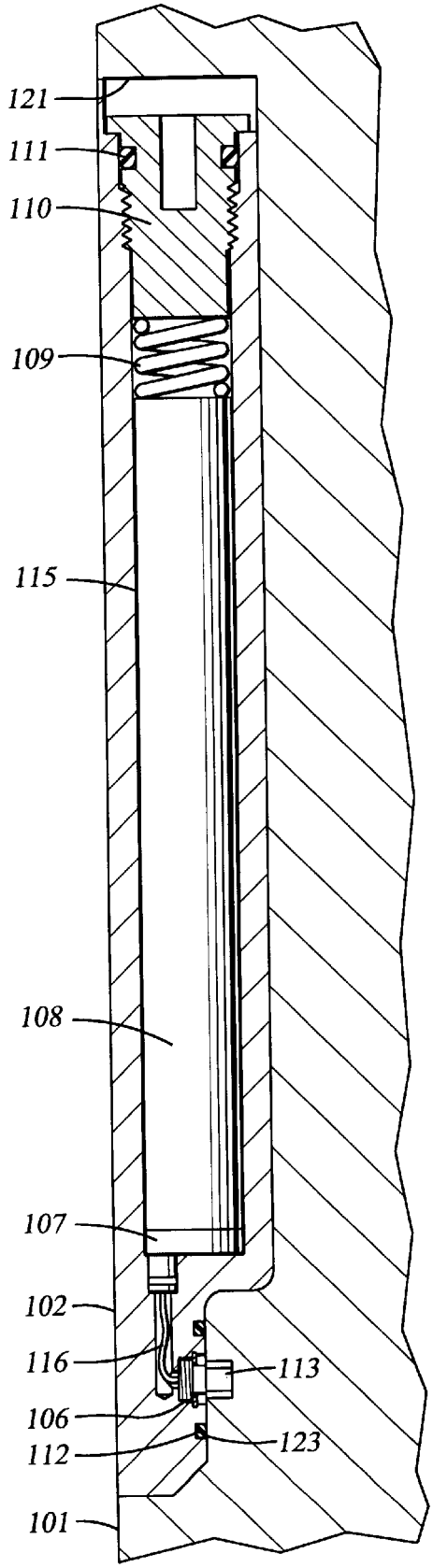
FIG. 3 is a schematic section of a downhole tool with a replaceable battery pack installed therein.
Figure 4:
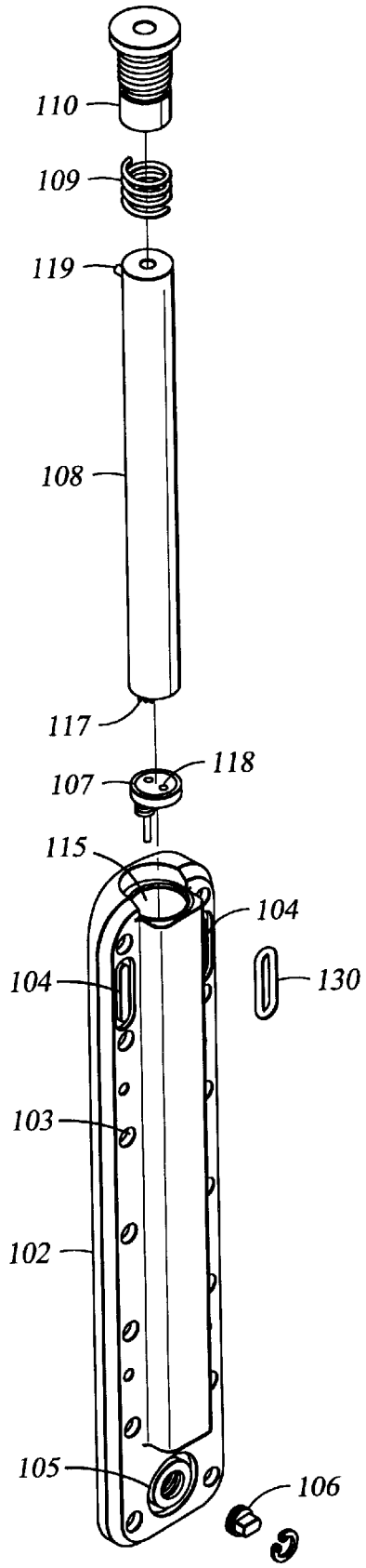
FIG. 4 is an exploded schematic of a downhole battery pack according to one embodiment of the present invention.

FIGS. 2–4 shows downhole tool 125 suitable for placement in a portion of a drill string such as BHA 59. In a preferred embodiment, tool 125 comprises a tubular member 101 such as a drill collar. Tool 125 has a replaceable battery module 120, also called a battery pack, inserted in a cavity 121 formed in an external surface of tubular member 101. Downhole sensors and circuits as discussed above may be disposed in the tubular member 101. The battery module 120 may provide power for such devices.

The battery module 120 comprises a housing 102 having a bore 115 adapted to receive a battery stack 108. Battery stack 108 may be a combination of multiple cells (not shown) or a single cell. If multiple cells are used for battery stack 108, they are typically encased in a plastic or metal cylinder. Such techniques are known in the art and are not discussed here further. Battery stack 108 is suitably wired to provide the required voltage and current properties for the particular application and has connection contacts 117 for engaging mating contacts 118 on connector 107. Electrical connector 107 is fitted into the end of bore 115 and is connected to connector 112 by wires 116. Battery stack 108 is inserted in bore 115 and is aligned by key 119 in stack 108 that aligns with a suitable groove (not shown) in housing 102. The key 119 provides alignment to ensure proper mating of contact pins 117 in stack 108 with mating contacts 118 in connector 107. Key 119 also prevents rotation of stack 108 during downhole drilling that might damage the connection between stack 108 and connector 107. Stack 108 is held in place by spring 109 that is captured in a compressed state between stack 108 and cap 110. The spring preload minimizes axial movement of the stack 108 during downhole drilling. Elastomeric seals 111 and 112 are used to seal out borehole fluids. Seal 112 resides in groove 105 and acts as a face type seal with surface 123 when module 120 is fastened to member 101 by mechanical fasteners 122 inserted though holes 103 and screwed into mating threaded holes (not shown) suitably arranged in cavity 121 in member 101. As module 120 is inserted into cavity 121, electrical connection is made between connector 106 in module 120 and connector 113 in member 101. Wires (not shown) are connected between the connector 113 and sensors and circuits (not shown) disposed in member 101. Such wiring techniques are known in the art and are not discussed here further. Any suitable mating connectors may be used for connectors 106 and 113 including but not limited to individual pin-to-socket connectors and coaxial connectors.

In another preferred embodiment, suitable circuitry (not shown) is included in module 120 to facilitate the use of inductive coupling techniques for transferring power between module 120 and circuits and sensors (not shown) in member 101.

Grooves 104, see FIG. 4, are adapted to receive an elastomeric seal 130 for use in providing a pressure lock to assist in holding the module 120 in cavity 121. When the module 120 is installed in the cavity 121, the seals 130 mate with the surface (not shown) in cavity 121. The volume enclosed by the seal 130 is at atmospheric pressure. Effectively, the downhole pressure times the area enclosed by the seal generates a force holding the housing 102 against the surface of cavity 121. At downhole pressures of several thousand pounds per square inch, even a small enclosed area results in a substantial holding force.

While the module 120 is described above as containing power cells, it is anticipated that such a module may contain other devices including but not limited to electronic circuits and sensors for measuring downhole parameters of interest. Such parameters include but are not limited to, annulus fluid pressure and annulus fluid temperature.

While only one module 120 is described as being attached to the tubular member 101, several such modules can be disposed on the tubular member. Such modules can be disposed at multiple angular positions around the tubular member at the same axial location; at multiple axial locations; or a combination of these.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A downhole tool for use in a wellbore, comprising;

a. a tubular member in a drill string, said tubular member having at least one cavity formed into an external surface thereof, said tubular member having a substantially uniform outer diameter in at least a portion of its length where said at least one cavity is formed;

b. at least one housing adapted to be insertably extractable in the at least one cavity, said housing sized such that an outer surface of said housing fits substantially flush with said substantially uniform outer diameter of said tubular member;

c. at least one electrical device disposed within the housing; and d. at least one seal disposed in at least one groove in said housing, said seal acting cooperatively with said housing and a surface of said cavity to form a pressure lock when exposed to a downhole pressure, said pressure lock acting to hold the housing in the cavity.

2. The downhole tool of claim 1, wherein the at least one electrical device is at least one electrical power cell.

3. The downhole tool of claim 1, wherein the at least one electrical device is a sensor for measuring at least one of (i) annulus pressure and (ii) annulus temperature.

4. The downhole tool of claim 1, wherein the at least one seal is made of an elastomeric material.

5. A replaceable battery pack for a downhole tool in a wellbore, comprising;

a. a housing adapted to be insertably extractable in a cavity on an external surface of the downhole tool, said housing sized to fit substantially flush with a substantially uniform outer diameter of said downhole tool, said housing adapted to be extracted from said downhole tool without further disassembling said downhole tool;

b. at least one seal disposed in at least one groove in said housing, said seal acting cooperatively with said housing and a surface of said cavity to form a pressure lock when exposed to a downhole pressure, said pressure lock acting to hold the housing in the cavity;

c. at least one electrical power cell disposed in the housing; and d. at least one electrical system disposed in said downhole tool disengageably engaged to said replaceable battery pack for receiving power from said replaceable battery pack.

6. The downhole tool of claim 5, wherein the at least one seal is made of an elastomeric material.

7. The downhole tool of claim 5, wherein the replaceable battery pack is adapted to be extracted from said downhole tool without further disassembly of said downhole tool.

8. The downhole tool of claim 5, wherein the at least one electrical system is at least one of (i) a sensor and (ii) an electronic circuit.

9. A method for providing a replaceable power source in a downhole tool, comprising:

a. providing a downhole tool having a substantially uniform outer diameter over at least a portion of the length of the downhole tool;

b. providing a replaceable battery pack including a housing having at least one battery therein, said housing adapted to be insertably extractable in a cavity formed into an external surface of the downhole tool;

c. providing at least one seal disposed in at least one groove in said housing, said seal acting cooperatively with said housing and a surface of said cavity to form a pressure lock when exposed to a downhole pressure, said pressure lock acting to hold the housing in the cavity;

d. extractably inserting said replaceable battery pack in said cavity while disengagingly engaging at least one electrical system in said downhole tool to provide electrical power thereto; and e. extracting said battery pack from said cavity while disengaging from said at least one electrical system, without requiring any additional disassembly of said downhole tool.

10. A method of locking an electrical device in a downhole tool, comprising;

a. disposing at least one seal in a groove on a surface of a housing;

b. inserting said housing containing the electrical device in a cavity on an external surface of the downhole tool such that said seal acts cooperatively with said housing and a surface of said cavity to capture a volume at atmospheric pressure; and c. deploying said tool downhole such that a pressure difference between a downhole pressure and atmospheric pressure of said captured volume acts to lock said electrical device in said cavity.

11. The method of claim 10, wherein the electrical device is one of (i) at least one electrical power cell and (ii) at least one sensor for measuring at least one downhole parameter of interest.

12. The method of claim 11, wherein the at least one seal is made of an elastomeric material.

* * * * *